US010134340B2

(12) United States Patent
Cho et al.

(10) Patent No.: US 10,134,340 B2
(45) Date of Patent: Nov. 20, 2018

(54) TIMING CONTROLLER, DISPLAY DEVICE INCLUDING THE SAME, AND METHOD OF DRIVING THE SAME

(71) Applicant: LG Display Co., Ltd., Seoul (KR)

(72) Inventors: Won Cho, Paju-si (KR); Jin Hyoung Kim, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/603,180

(22) Filed: May 23, 2017

(65) Prior Publication Data

US 2017/0345375 A1 Nov. 30, 2017

(30) Foreign Application Priority Data

May 31, 2016 (KR) ..... 10-2016-0067206

(51) Int. Cl.

| | |
|---|---|
| ***G09G 3/3275*** | (2016.01) |
| ***G09G 3/20*** | (2006.01) |
| ***G09G 3/3266*** | (2016.01) |
| ***G09G 5/18*** | (2006.01) |

(52) U.S. Cl.

CPC ..... *G09G 3/3275* (2013.01); *G09G 3/20* (2013.01); *G09G 3/2092* (2013.01); *G09G 3/3266* (2013.01); *G09G 5/18* (2013.01); *G09G 2310/08* (2013.01); *G09G 2360/12* (2013.01)

(58) Field of Classification Search

CPC ..... G09G 3/3275; G09G 3/20; G09G 3/2092; G09G 3/3266

See application file for complete search history.

(56) References Cited

U.S. PATENT DOCUMENTS

| | | | | |
|---|---|---|---|---|
| 9,390,666 | B2 * | 7/2016 | Oh | G09G 3/2025 |
| 2007/0152951 | A1 * | 7/2007 | Ahn | G09G 3/342 345/102 |
| 2007/0229418 | A1 * | 10/2007 | Yun | G09G 3/2092 345/87 |
| 2010/0265272 | A1 * | 10/2010 | Bae | G09G 3/2003 345/690 |
| 2011/0292041 | A1 * | 12/2011 | Lee | G09G 3/342 345/419 |

(Continued)

FOREIGN PATENT DOCUMENTS

KR 10-2015-0035109 A 4/2015

*Primary Examiner* — Ricardo L Osorio

(74) *Attorney, Agent, or Firm* — Seed Intellectual Property Law Group LLP

(57) ABSTRACT

A timing controller includes an input signal processor that receives a data enable signal and a frame frequency information signal, generates one of a first internal data enable signal having a first frame frequency and a second internal data enable signal having a second frame frequency, the first and second frame frequencies being selected based on the frame frequency information signal. A gate control signal output unit generates and outputs a first gate control signal based on the first internal data enable signal or a second gate control signal based on the second internal data enable signal. A data control signal output unit generates and outputs a first data control signal based on the first internal data enable signal or a second data control signal based on the second internal data enable signal. The pulse widths of the first and second internal data enable signals are the same.

20 Claims, 6 Drawing Sheets

(56) References Cited

U.S. PATENT DOCUMENTS

| | | | | |
|---|---|---|---|---|
| 2015/0206502 | A1* | 7/2015 | Hwang | G09G 3/3618 345/213 |
| 2015/0243232 | A1* | 8/2015 | Kim | G09G 3/3648 345/214 |
| 2016/0035297 | A1 | 2/2016 | Oh et al. | |
| 2016/0203755 | A1* | 7/2016 | Kim | H04B 15/00 345/545 |
| 2016/0322012 | A1* | 11/2016 | Oh | G09G 3/3648 |
| 2017/0038898 | A1* | 2/2017 | Kim | G09G 3/3225 |
| 2017/0046006 | A1* | 2/2017 | Kim | G02F 1/13338 |

* cited by examiner

TIMING CONTROLLER, DISPLAY DEVICE INCLUDING THE SAME, AND METHOD OF DRIVING THE SAME

CROSS-REFERENCE TO RELATED APPLICATIONS

This application claims the benefit of the Korean Patent Application No. 10-2016-0067206 filed on May 31, 2016, which is hereby incorporated by reference as if fully set forth herein.

BACKGROUND

Technical Field

The present disclosure relates to a timing controller, a display device including the same, and a method of driving the same.

Description of the Related Art

With the advancement of information-oriented society, various requirements for display devices for displaying an image are increasing. Therefore, various display devices such as liquid crystal display (LCD) devices, plasma display panel (PDP) devices, organic light emitting display devices, and the like are being used recently.

Display devices each include a display panel, a gate driving circuit, a data driving circuit, and a timing controller.

The display panel generally includes a plurality of data lines, a plurality of gate lines, and a plurality of pixels which are respectively provided in a plurality of pixel areas defined by intersections of the data lines and the gate lines. The pixels are supplied with data voltages through the data lines when gate signals are supplied through the gate lines. The pixels emit lights having certain brightnesses associated with the data voltages, respectively.

The timing controller receives video data and timing signals from an external system board and generates a gate control signal for controlling an operation timing of the gate driving circuit and a data control signal for controlling an operation timing of the data driving circuit based on the timing signals. The timing controller outputs the gate control signal to the gate driving circuit and outputs the data control signal to the data driving circuit.

The gate driving circuit generates the gate signals according to the gate control signal and supplies the gate signals to the gate lines. The data driving circuit generates the data voltages according to the data control signal and supplies the data voltages to the data lines.

The timing controller is driven at a frame frequency corresponding to an input frame frequency. For example, the timing controller is driven based on a data enable signal of 60 Hz shown in FIG. 1 when the video data and the timing signals are input at a frame frequency of 60 Hz. The timing controller is driven based on a data enable signal of 120 Hz shown in FIG. 1 when the video data and the timing signals are input at a frame frequency of 120 Hz.

Recently, display devices driven at various frame frequencies have been developed. For example, display devices capable of being driven at both a frame frequency of 60 Hz and a frame frequency of 120 Hz have been developed.

However, as in FIG. 1, a pulse width W1 of the data enable signal when the frame frequency is 60 Hz differs from a pulse width W2 of the data enable signal when the frame frequency is 120 Hz. Therefore, the timing controller adjusts a pulse width of an internal clock to be synchronized with the pulse width of the data enable signal driven at 60 Hz when the timing controller is driven at the frame frequency of 60 Hz. Also, the timing controller adjusts the pulse width of the internal clock to be synchronized with the pulse width of the data enable signal driven at 120 Hz when the timing controller is driven at the frame frequency of 120 Hz. Thus, a 60 Hz signal processing block counts an internal clock of 60 Hz, and a 120 Hz signal processing block counts an internal clock of 120 Hz. Therefore, the counting of the internal clock by the 60 Hz signal processing block differs from the counting of the internal clock by the 120 Hz signal processing block. For this reason, a complexity of an internal logic of the timing controller increases.

Moreover, when the timing controller is driven at a plurality of frame frequencies, the timing controller may include a block which processes timing signals and video data for 60 Hz and another block which processes timing signals and video data for 120 Hz, for decreasing the complexity of the internal logic. However, a size of the timing controller increases, causing an increase in the manufacturing cost of display devices.

SUMMARY

Accordingly, the present disclosure provides various embodiments, including a timing controller, a display device including the same, and a method of driving the same that substantially reduces one or more problems due to limitations and disadvantages of the related art.

An aspect of the present disclosure is directed to a timing controller, a display device including the same, and a method of driving the same, in which despite being driven at a plurality of frame frequencies, an internal logic is simplified, and moreover, the manufacturing cost does not increase without any increase in size.

Additional advantages and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these and other advantages and in accordance with the purpose of the disclosure, as embodied and broadly described herein, there is provided a timing controller including an input signal processor, a gate control signal output unit, and a data control signal output unit. The input signal processor receives a data enable signal and a frame frequency information signal, generates a first internal data enable signal having a first frame frequency when the first frame frequency is selected based on the frame frequency information signal, and generates a second internal data enable signal having a second frame frequency when the second frame frequency is selected based on the frame frequency information signal. The gate control signal output unit generates and outputs a first gate control signal based on the first internal data enable signal or generates and outputs a second gate control signal based on the second internal data enable signal. The data control signal output unit generates and outputs a first data control signal based on the first internal data enable signal or generates and outputs a second data control signal based on the second internal data enable signal. A pulse width of the first internal data enable signal is the same as a pulse width of the second internal data enable signal.

In another aspect of the present disclosure, there is provided a display device including a display panel including a plurality of gate lines, a plurality of data lines, and a plurality of pixels connected to the plurality of gate lines and the plurality of data lines, a gate driver respectively outputting gate signals to the plurality of gate lines, a data driver respectively outputting data voltages to the plurality of data lines, and a timing controller controlling an operation timing of the gate driver and an operation timing of the data driver. The timing controller includes an input signal processor, a gate control signal output unit, and a data control signal output unit. The input signal processor receives a data enable signal and a frame frequency information signal, generates a first internal data enable signal having a first frame frequency when the first frame frequency is selected based on the frame frequency information signal, and generates a second internal data enable signal having a second frame frequency when the second frame frequency is selected based on the frame frequency information signal. The gate control signal output unit generates and outputs a first gate control signal based on the first internal data enable signal or generates and outputs a second gate control signal based on the second internal data enable signal. The data control signal output unit generates and outputs a first data control signal based on the first internal data enable signal or generates and outputs a second data control signal based on the second internal data enable signal. A pulse width of the first internal data enable signal is the same as a pulse width of the second internal data enable signal.

In another aspect of the present disclosure, there is provided a method of driving a display device including receiving first frame frequency data and second frame frequency data from a memory, and receiving image data and a frame frequency information signal from an external system board, generating a first internal data enable signal having a first frame frequency according to the first frame frequency data when the first frame frequency is selected based on the frame frequency information signal, generating a second internal data enable signal having a second frame frequency according to the second frame frequency data when the second frame frequency is selected based on the frame frequency information signal, generating a first gate control signal based on the first internal data enable signal to output the first gate control signal to a gate driver, or generating a second gate control signal based on the second internal data enable signal to output the second gate control signal to the gate driver, and generating a first data control signal based on the first internal data enable signal to output the first data control signal to a data driver, or generating a second data control signal based on the second internal data enable signal to output the second data control signal to the data driver. A pulse width of the first internal data enable signal is the same as a pulse width of the second internal data enable signal.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Figure 1:
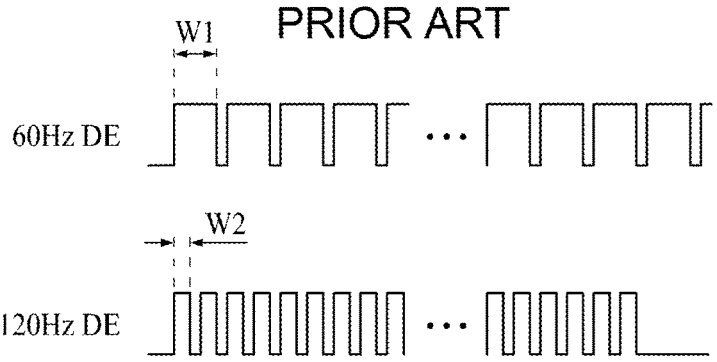
FIG. 1 PRIOR ART
FIG. 1 is a waveform diagram showing a data enable signal input at a frame frequency of 60 Hz and a data enable signal input at a frame frequency of 120 Hz.

Reference will now be made in detail to the exemplary embodiments of the present disclosure, examples of which are illustrated in the accompanying drawings. Wherever possible, the same reference numbers will be used throughout the drawings to refer to the same or like parts.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will convey the scope of the present disclosure to those skilled in the art. Further, the present disclosure is only defined by the claims.

A shape, a size, a ratio, an angle, and a number disclosed in the drawings for describing embodiments of the present disclosure are merely exemplary, and thus, the present disclosure is not limited to the illustrated details. Like reference numerals refer to like elements throughout. In the following description, when a detailed description of a known function or configuration is determined to unnecessarily obscure the description of the various embodiments of the present disclosure, then such detailed description will be omitted since it is known to those of skill in the art.

In a case where 'comprise', 'have', and 'include' described in the present specification are used, another part may be added unless 'only' is used. The terms of a singular form may include plural forms unless referred to the contrary.

In construing an element, the element is to be construed as including some tolerance or range for errors, although there is no explicit description to such tolerance or range for errors.

In describing a position relationship, for example, when a position relation between two parts is described as 'on', 'cover', 'under', and 'next', one or more other parts may be disposed between the two parts unless further limiting words are included, such as 'just' or 'direct', to expressly exclude such meaning.

In describing a time relationship, for example, when the temporal order is described as 'after', 'subsequent', 'next', and 'before', a case which is not continuous or has intervening steps may be included unless further limiting words are expressly added, such as 'just' or 'direct'.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

An X axis direction, a Y axis direction, and a Z axis direction should not be construed as only a geometric relationship where a relationship therebetween is vertical, and may denote having a broader directionality within a scope where elements of the present disclosure operate functionally.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, exemplary embodiments of the present disclosure will be described in detail with reference to the accompanying drawings.

Figure 2:
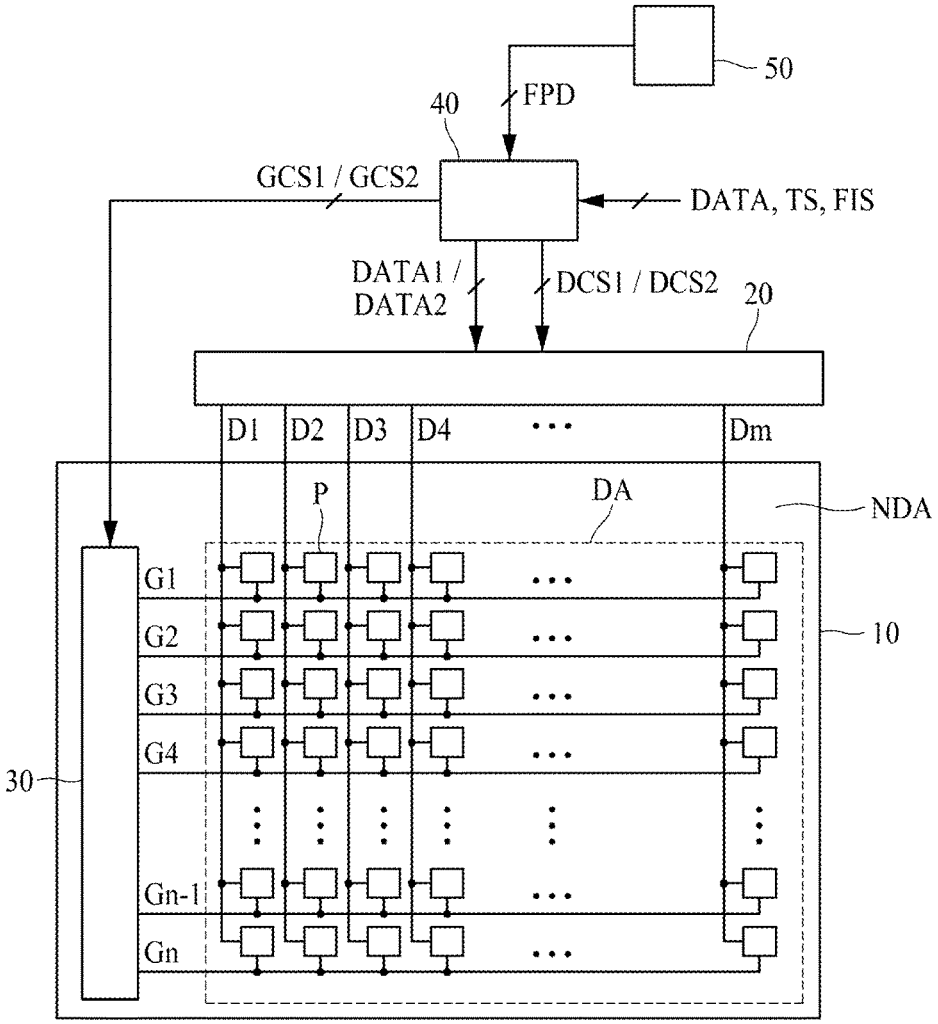
FIG. 2 is a block diagram illustrating a display device according to one or more embodiments of the present disclosure.
Figure 3:
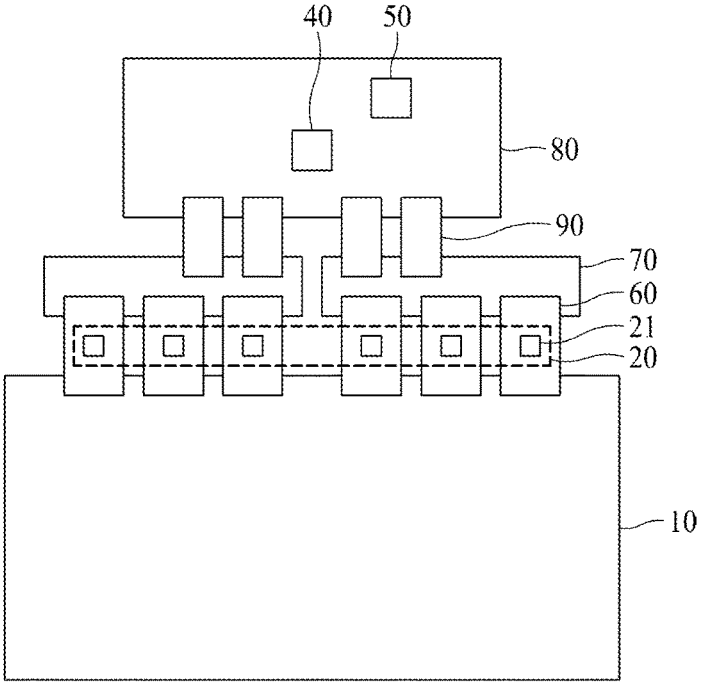
FIG. 3 is a block diagram illustrating a lower substrate, a source drive integrated circuit (IC), a timing controller, a memory, source flexible films, a source circuit board, and a control circuit board of a display device according to embodiments of the present disclosure.

FIG. 2 is a block diagram illustrating a display device according to one or more embodiments of the present disclosure. FIG. 3 is a block diagram illustrating a lower substrate, a source drive integrated circuit (IC), a timing controller, a memory, source flexible films, a source circuit board, and a control circuit board of a display device according to embodiments of the present disclosure.

Examples of the display device according to embodiments of the present disclosure may include all display devices which supply data voltages through a line scanning operation of supplying gate signals to a plurality of gate lines G1 to Gn. For example, the display device according to embodiments of the present disclosure may be implemented as one of a liquid crystal display (LCD) device, an organic light emitting display device, a field emission display device, and an electrophoresis display device. Hereinafter, an example where a display device according to embodiments of the present disclosure is implemented as an organic light emitting display device will be described, but is not limited thereto.

Referring to FIGS. 2 and 3, the display device according to one or more embodiments of the present disclosure may include a display panel 10, a data driver 20, a gate driver 30, a timing controller 40, a memory 50, a source flexible film 60, a source circuit board 70, a control circuit board 80, and a flexible cable 90.

The display panel 10 may include an upper substrate and a lower substrate. A display area DA, which includes a plurality of data lines D1 to Dm (where m is an integer equal to or more than two), a plurality of gate lines G1 to Gn (where n is an integer equal to or more than two), and a plurality of pixels P, may be provided on the lower substrate. The data lines D1 to Dm may be provided to intersect the gate lines G1 to Gn. Also, a plurality of initialization lines parallel to the gate lines G1 to Gn may be provided on the lower substrate, and a plurality of reference voltage lines parallel to the data lines D1 to Dm may be provided on the lower substrate. Each of the pixels P may be connected to one corresponding data line of the data lines D1 to Dm, one corresponding gate line of the gate lines G1 to Gn, one corresponding initialization line of the initialization lines, and one corresponding reference voltage line of the reference voltage lines.

Figure 4:
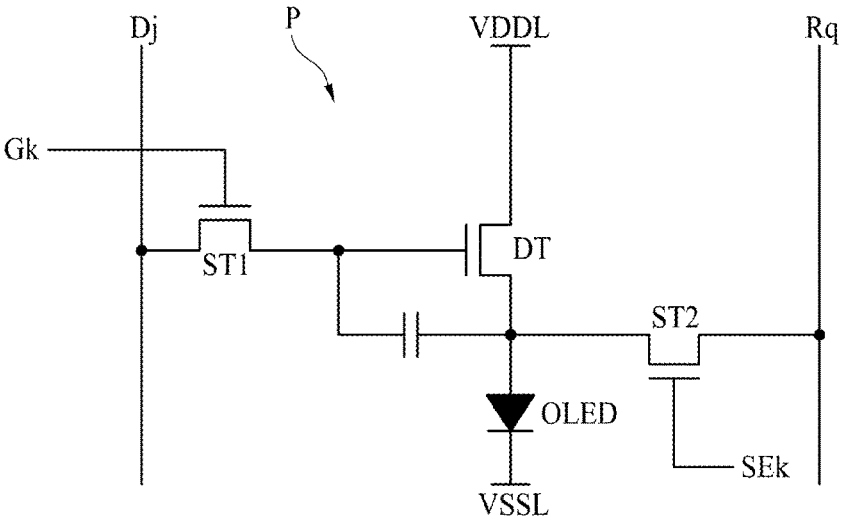
FIG. 4 is a circuit diagram illustrating a pixel of the display device of FIG. 2.

Each of the pixels P, as shown in FIG. 4, may include an organic light emitting diode OLED, a driving transistor DT, first and second transistors ST1 and ST2, and a capacitor C. A detailed description of each pixel P will be made with reference to FIG. 4.

The gate driver 30 may be connected to the gate lines G1 to Gn and may respectively supply gate signals to the gate lines G1 to Gn. In detail, the gate driver 30 may receive a first gate control signal GCS1 having a first frame frequency or a second gate control signal GCS2 having a second frame frequency. The gate driver 30 may generate gate signals having the first frame frequency according to the first gate control signal GCS1 to supply the generated gate signals to the gate lines G1 to Gn. Alternatively, the gate driver 30 may generate gate signals having the second frame frequency according to the second gate control signal GCS2 to supply the generated gate signals to the gate lines G1 to Gn.

The gate driver 30 may be provided in a non-display area NDA in a gate driver in panel (GIP) type. In FIG. 2, the gate driver 30 is illustrated as being provided outside one side of the display area DA, but is not limited thereto. For example, the gate driver 30 may be provided outside both sides of the display area DA. The display panel 10 may be divided into the display area DA and the non-display area NDA. The display area DA may be an area where the pixels P are provided to display an image. The non-display area NDA may be an area which is provided near the display area DA and does not display an image.

Alternatively, the gate driver 30 may include a plurality of gate drive integrated circuits (ICs), and the gate drive ICs may be respectively mounted on gate flexible films. The gate flexible films may each be a tape carrier package or a chip-on film. The gate flexible films may be attached on the non-display area NDA of the display panel 10 in a tape automated bonding (TAB) type by using an anisotropic conductive film, and thus, the gate drive ICs may be connected to the gate lines G1 to Gn.

The data driver 20 may be connected to the data lines D1 to Dm. The data driver 20 may receive first or second image data DATA1/DATA2 and a first or second data control signal DCS1/DCS2. The data driver 20 may convert the first image data DATA1 into analog data voltages according to the first data control signal DCS1. Alternatively, the data driver 20 may convert the second image data DATA2 into analog data voltages according to the second data control signal DCS2. The data driver 20 may respectively supply the analog data voltages to the data lines D1 to Dm.

The data driver 20 may include at least one source drive IC 21. Each of the source drive ICs 21 may be manufactured as a driving chip. The source drive ICs 21 may be respectively mounted on the source flexible films 60. Each of the source flexible films 60 may be implemented as a tape carrier package or a chip-on film and may be bent or curved. The source flexible films 60 may be attached on the non-display area NDA of the display panel 10 in a TAB type by using an anisotropic conductive film, and thus, the source drive ICs 21 may be connected to the data lines D1 to Dm.

Moreover, the source flexible films 60 may be attached on the source circuit board 70. The source circuit board 70 may be a flexible printed circuit board (FPCB) able to be bent or curved.

The timing controller 40 may receive image data DATA, timing signals TS, and a frame frequency information signal FIS from the external system board (not shown). The timing signals may include a vertical synchronization signal, a horizontal synchronization signal, and a data enable signal. Also, the timing controller 40 may receive a plurality of pieces of frame frequency data FPD from the memory 50.

The timing controller 40 may select a frame frequency, at which the display panel 10 is to be driven, from among a plurality of frame frequencies according to the frame frequency information signal FIS. The timing controller 40 may generate an internal data enable signal according to the selected frame frequency based on frame frequency data FPD corresponding to the selected frame frequency. Subsequently, the timing controller 40 may generate the first or second gate control signal GCS1/GCS2 for controlling the operation timing of the gate driver 30 and the first or second data control signal DCS1/DCS2 for controlling the operation timing of the data driver 20 based on the generated internal data enable signal.

Moreover, the timing controller 40 may convert the image data DATA into the first or second image data DATA1/DATA2 synchronized with the internal data enable signal. The timing controller 40 may supply the first or second image data DATA1/DATA2 and the first or second data control signal DCS1/DCS2 to the data driver 20. The timing controller 40 may supply the first or second gate control signal GCS1/GCS2 to the gate driver 30.

A detailed description of the timing controller 40 will be made with reference to FIGS. 5 to 8.

The memory 50 may store the pieces of frame frequency data FPD, for example, first and second frame frequency data. Thus, the first frame frequency data may be driving timing data for generating an internal data enable signal having a first frequency, and the second frame frequency data may be driving timing data for generating an internal data enable signal having a second frequency. When the display device is powered on, the memory 50 may perform inter-integrated circuit (I2C) communication with the timing controller 40 by using a serial clock (SCL) signal and a serial data (SDA) signal to transmit the pieces of frame frequency data FPD to the timing controller 40. The memory 50 may be, for example, electrically erasable programmable read-only memory (EEPROM).

The timing controller 40 and the memory 50, as shown in FIG. 3, may be mounted on the control circuit board 80. The source circuit board 70 and the control circuit board 80 may be connected to each other through the flexible cable 90, such as a flexible flat cable (FFC) or a flexible printed circuit (FPC). The control circuit board 80 may be an FPCB able to be bent or curved.

FIG. 4 is a circuit diagram illustrating a pixel P of the display device shown in FIG. 2. In FIG. 4, for convenience of description, only a pixel P connected to a jth (where j is an integer satisfying $1 \le j \le m$) data line Dj, a qth (where q is an integer satisfying $1 \le q \le p$) reference voltage line Rq, a kth (where k is an integer satisfying $1 \le k \le n$) gate line Gk, and a kth initialization line SEk is illustrated.

Referring to FIG. 4, the pixel P may include an organic light emitting diode OLED, a driving transistor DT, a plurality of switching transistors ST1 and ST2, and a capacitor C. The plurality of switching transistors ST1 and ST2 may include a first switching transistor ST1 and a second switching transistor ST2.

The organic light emitting diode OLED may emit light with a current supplied through the driving transistor DT. An anode electrode of the organic light emitting diode OLED may be coupled to a source electrode of the driving transistor DT, and a cathode electrode may be coupled to a first source voltage line VSSL through which a first source voltage is supplied. The first source voltage line VSSL may be a low-level voltage line through which a low-level source voltage is supplied.

The organic light emitting diode OLED may include the anode electrode, a hole transporting layer, an organic light emitting layer, an electron transporting layer, and the cathode electrode. In the organic light emitting diode OLED, when a voltage is applied to the anode electrode and the cathode electrode, a hole and an electron may respectively move to the organic light emitting layer through the hole transporting layer and the electron transporting layer and may be combined with each other in the organic light emitting layer to emit light.

The driving transistor DT may be disposed between the organic light emitting diode OLED and a second source voltage line VDDL through which a second source voltage is supplied. The driving transistor DT may control a current flowing from the second source voltage line VDDL to the organic light emitting diode OLED according to a voltage difference between a gate electrode and a source electrode of the driving transistor DT. The gate electrode of the driving transistor DT may be coupled to a first electrode of the first switching transistor ST1, the source electrode of the driving transistor DT may be coupled to the anode electrode of the organic light emitting diode OLED, and a drain electrode of the driving transistor DT may be coupled to the second source voltage line VDDL. The second source voltage line VDDL may be a high-level voltage line through which a high-level source voltage is supplied.

The first switching transistor ST1 may be turned on by a kth gate signal of the kth gate line Gk and may supply a voltage of the jth data line Dj to the gate electrode of the driving transistor DT. A gate electrode of the first switching transistor ST1 may be coupled to the kth gate line Gk, a first electrode may be coupled to the gate electrode of the driving transistor DT, and a second electrode may be coupled to the jth data line Dj.

The second switching transistor ST2 may be turned on by a kth initialization signal of the kth initialization line SEk and may connect the qth reference voltage line Rq to the source electrode of the driving transistor DT. A gate electrode of the second switching transistor ST2 may be coupled to the kth initialization line SEk, a first electrode may be coupled to the qth reference voltage line Rq, and a second electrode may be coupled to the source electrode of the driving transistor DT.

The first electrode of each of the first and second switching transistors ST1 and ST2 may be a source electrode, and the second electrode may be a drain electrode. However, embodiments provided by the present disclosure are not limited thereto. In other embodiments, the first electrode of each of the first and second switching transistors ST1 and ST2 may be the drain electrode, and the second electrode may be the source electrode.

The capacitor C may be provided between the gate electrode and the source electrode of the driving transistor DT. The capacitor C may store a difference voltage between a gate voltage and a source voltage of the driving transistor DT.

In FIG. 4, the first and second switching transistors ST1 and ST2 and the driving transistor DT have been described as being provided as an N-type metal oxide semiconductor field effect transistor (MOSFET), but are not limited thereto. In other embodiments, one or more of the first and second transistors ST1 and ST2 and the driving transistor DT may be provided as a P-type MOSFET.

Figure 5:
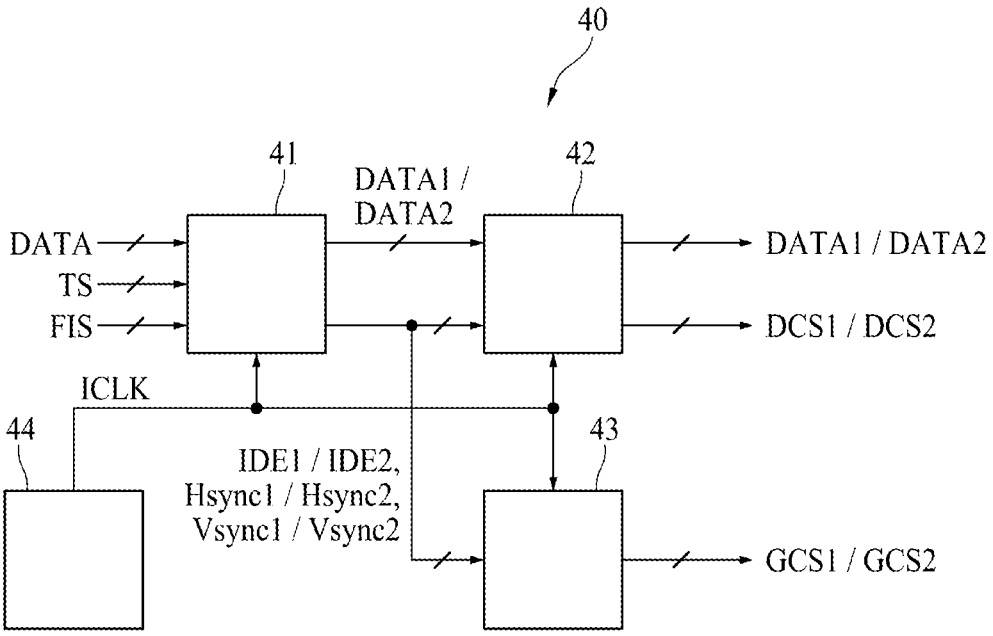
FIG. 5 is a block diagram illustrating in detail a timing controller of the display device of FIG. 2.
Figure 6:
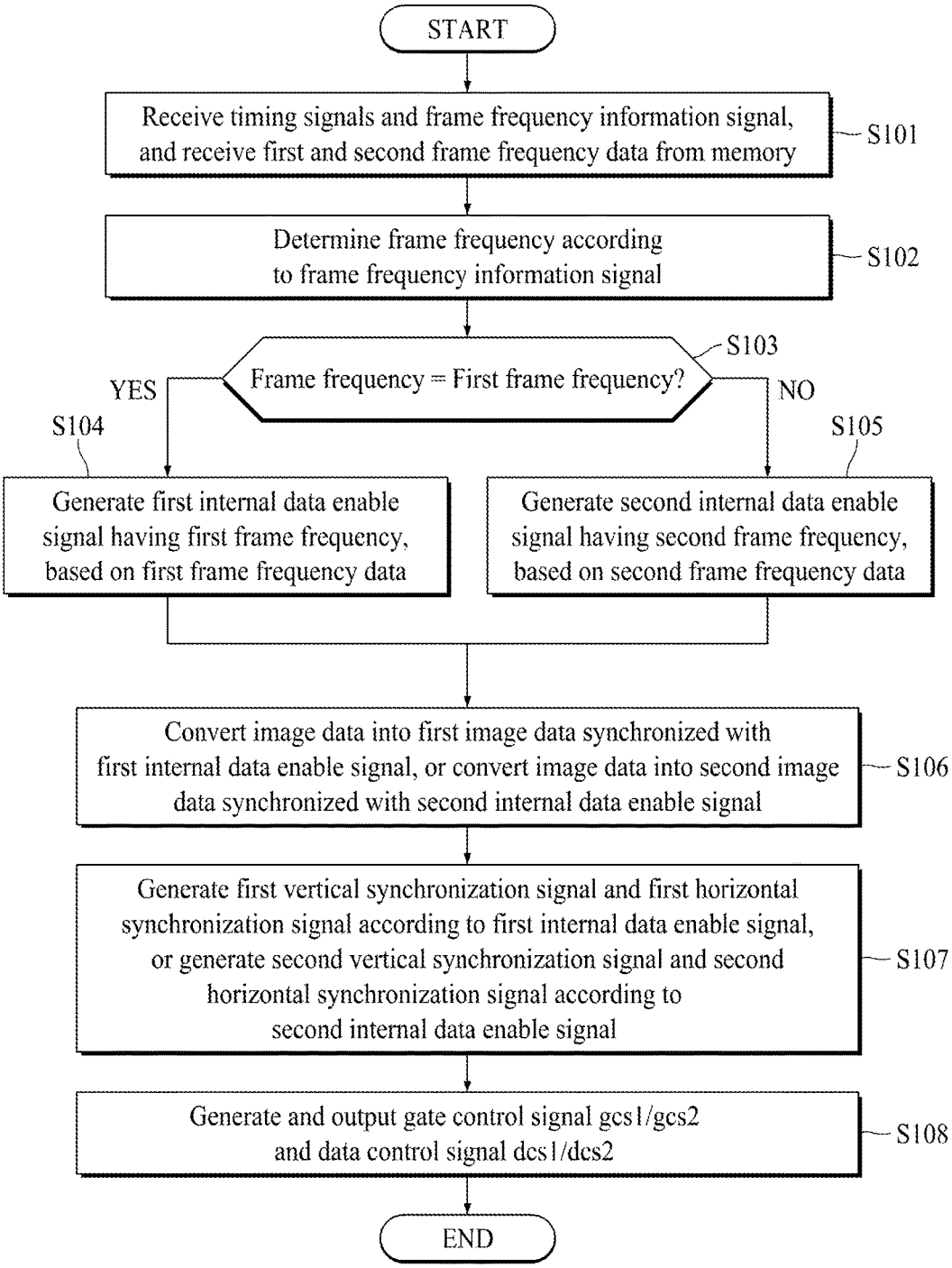
FIG. 6 is a flowchart illustrating in detail a method of driving a timing controller, according to embodiments of the present disclosure.

FIG. 5 is a block diagram illustrating in detail the timing controller of the display device shown in FIG. 2. FIG. 6 is a flowchart illustrating in detail a method of driving the timing controller, according to an embodiment of the present disclosure.

Referring to FIG. 5, the timing controller 40 may include an input signal processor 41, a data control signal output unit 42, a gate control signal output unit 43, and an internal clock generator 44. The input signal processor 41 may process timing signals TS and image data DATA input from the external system board so as to match the display device and may output the processed timing signals TS and image data DATA to the data control signal output unit 42 and the gate control signal output unit 43. The data control signal output unit 42 may generate and output the data control signal based on the timing signals TS from the input signal processor 41. The gate control signal output unit 43 may generate and output the gate control signal based on the processed timing signals TS from the input signal processor 41. The internal clock generator 44 may include an oscillator. The internal clock generator 44 may generate an internal clock ICLK having a certain frequency and may output the internal clock ICLK to the input signal processor 41, the data control signal output unit 42, and the gate control signal output unit 43. The input signal processor 41, the data control signal output unit 42, and the gate control signal output unit 43 may count the internal clock ICLK to generate signals.

Hereinafter, a method of driving the timing controller 40 according to an embodiment of the present disclosure will be described with reference to FIGS. 5 and 6.

At S101, the input signal processor 41 may receive the image data DATA, the timing signals TS, and the frame frequency information signal FIS from the external system board. Also, the timing controller 40 may receive the pieces of frame frequency data FPD1 and FPD2 from the memory 50.

The image data DATA may be digital data including gray level information about an image. If the image data DATA is 8-bit digital data, the image data DATA may be represented at 256 gray levels.

The timing signals TS may include a vertical synchronization signal, a horizontal synchronization signal, and a data enable signal. The vertical synchronization signal may be a signal indicating one frame period. The horizontal synchronization signal may be a signal indicating one horizontal period. The data enable signal may be a signal indicating a period where valid image data DATA is input.

The frame frequency information signal FIS may be a signal indicating a frame frequency of each of the timing signals TS and the image data DATA input to the timing controller 40. For example, if the frame frequency information signal FIS has a first logic level voltage, the image data DATA and the timing signals TS may be input at the first frame frequency. Also, if the frame frequency information signal FIS has a second logic level voltage, the image data DATA and the timing signals TS may be input at the second frame frequency. The first frame frequency may be lower than the second frame frequency. For example, in an embodiment of the present disclosure, the first frame frequency is described as 60 Hz, and the second frame frequency is described as 120 Hz. However, the present embodiment is not limited thereto.

The first frame frequency data FPD1 may be data of a driving timing for generating the internal data enable signal having the first frame frequency, and the second frame frequency data FPD2 may be data of a driving timing for generating the internal data enable signal having the second frame frequency.

At S102, the input signal processor 41 may determine a frame frequency at which the display panel 10 is to be driven based on the frame frequency information signal FIS. For example, if the frame frequency information signal FIS indicates the first frame frequency, the input signal processor 41 may drive the display panel 10 at the first frame frequency. Also, if the frame frequency information signal FIS indicates the second frame frequency, the input signal processor 41 may drive the display panel 10 at the second frame frequency.

At S103 the method proceeds to either S104 or S105, based on whether the determined frame frequency is the first frame frequency or the second frame frequency. At S104, when the frame frequency is determined as the first frame frequency, the input signal processor 41 may generate a first internal data enable signal IDE1 having the first frame frequency based on the first frame frequency data FPD1. At S105, when the frame frequency is determined as the second frame frequency, the input signal processor 41 may generate a second internal data enable signal IDE2 having the second frame frequency based on the second frame frequency data FPD2.

Figure 7:
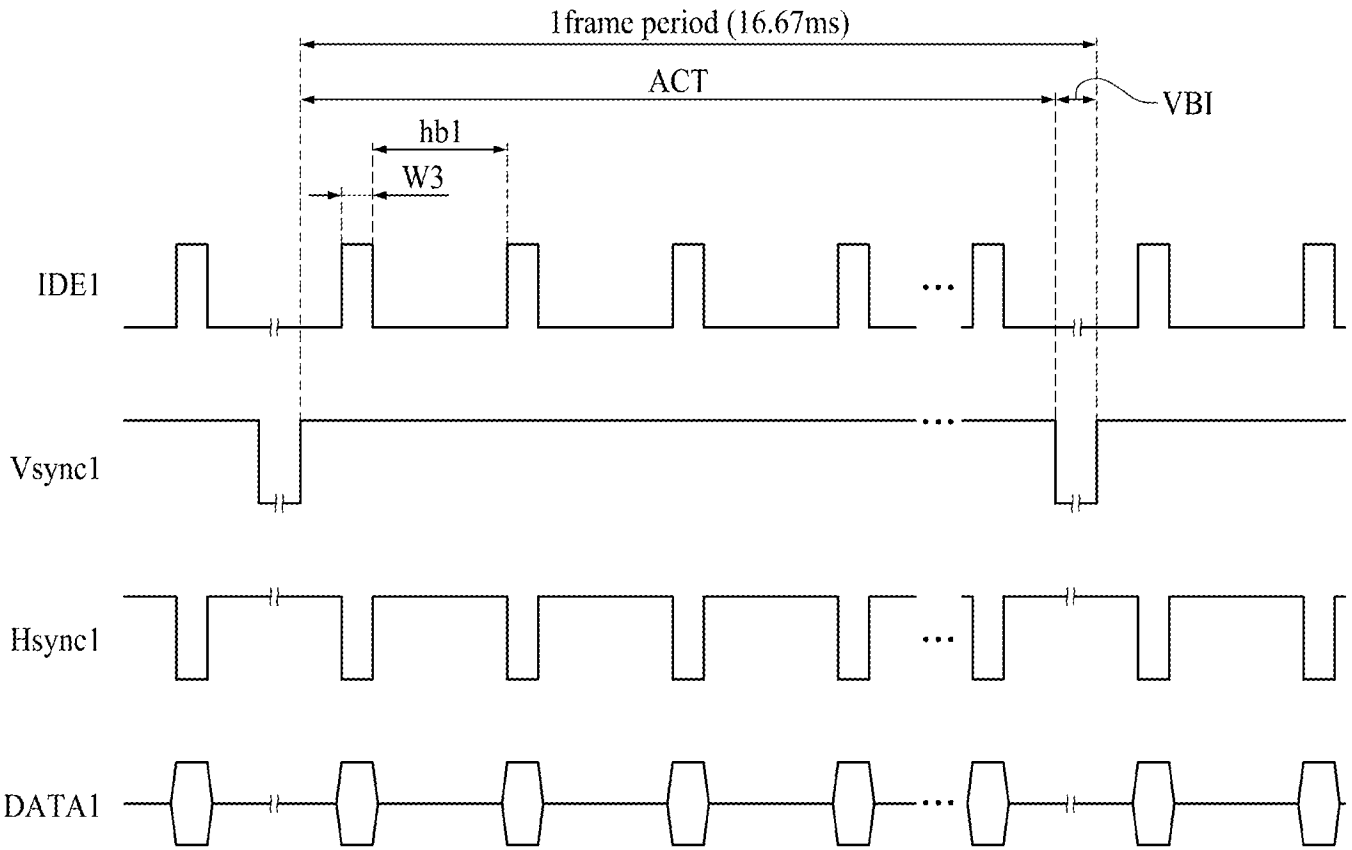
FIG. 7 is a waveform diagram showing a first internal data enable signal, a first vertical synchronization signal, a first horizontal synchronization signal, and first image data generated by a timing controller, in accordance with embodiments of the present disclosure.
Figure 8:
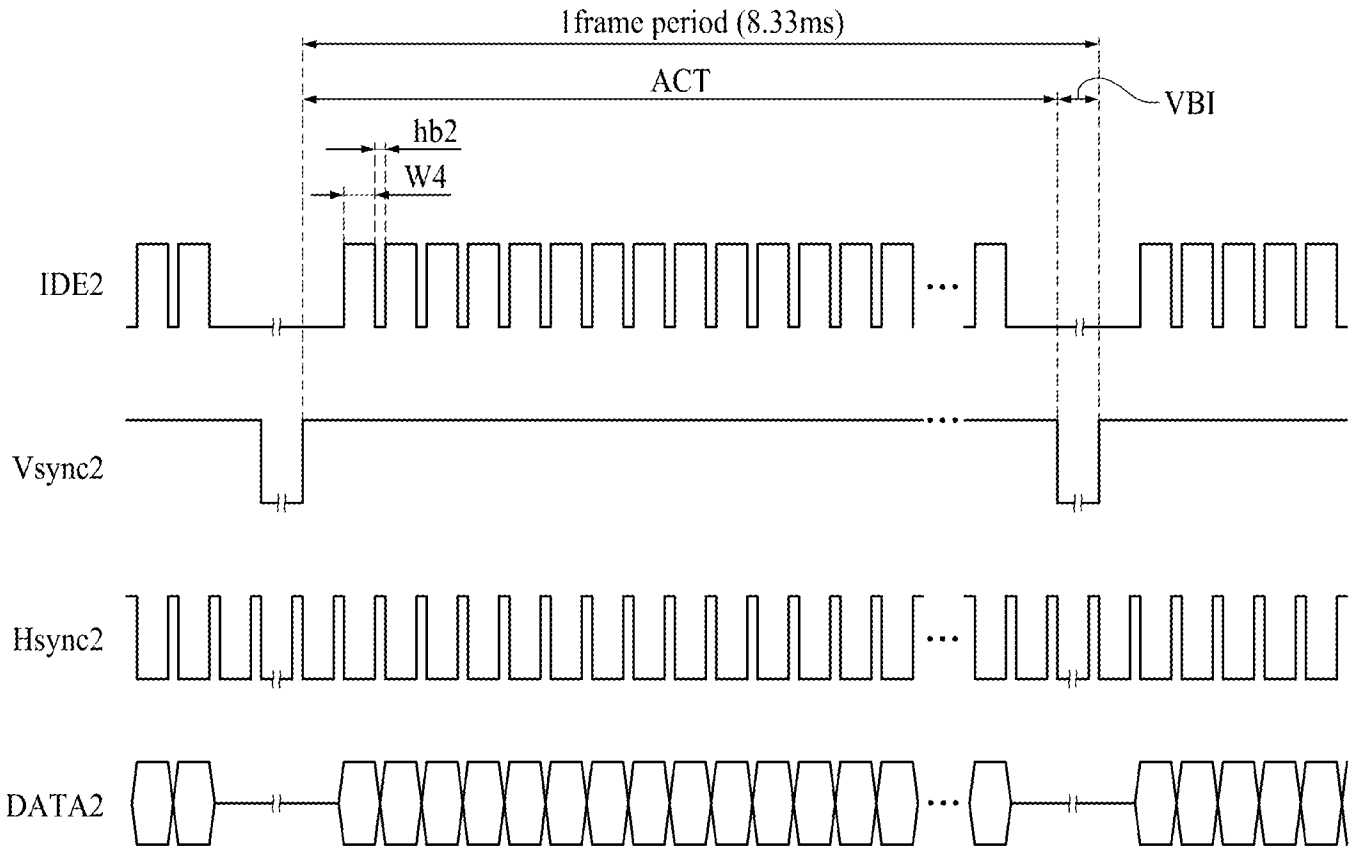
FIG. 8 is a waveform diagram showing a second internal data enable signal, a second vertical synchronization signal, a second horizontal synchronization signal, and second image data generated by a timing controller, in accordance with embodiments of the present disclosure.

Even when the first internal data enable signal IDE1 is activated to the first frame frequency and the second internal data enable signal IDE2 is activated to the second frame frequency, as in FIGS. 7 and 8, a pulse width W3 of the first internal data enable signal IDE1 may be generated as a pulse width which is substantially the same as a pulse width W4 of the second internal data enable signal IDE2 having the second frame frequency. Therefore, even when the first internal data enable signal IDE1 and the data enable signal input from the system board are activated to the same frame frequency, the pulse width W3 of the first internal data enable signal IDE1 shown in FIG. 7 may be narrower than the pulse width W1 of the data enable signal input from the system board as in FIG. 1.

As a result, in an embodiment of the present disclosure, an input signal may be processed by using the first internal data enable signal IDE1 and the second internal data enable signal IDE2 having the same pulse width, and thus, it is not required for the data control signal output unit 42 and the gate control signal output unit 43 disposed next to the input signal processor 41 to adjust counting of the internal clock ICLK according to a frame frequency. That is, the data control signal output unit 42 and the gate control signal output unit 43 may process the input signal by using only the internal clock ICLK. Accordingly, in an embodiment of the present disclosure, despite the display device being driven at a plurality of frame frequencies, an internal logic is simplified.

Moreover, in an embodiment of the present disclosure, since the internal logic is simplified, it is not required to distinguish blocks processing the image data DATA and the timing signals TS according to the frame frequency. Accordingly, in an embodiment of the present disclosure, despite the display device being driven at a plurality of frame frequencies, the cost does not increase without any increase in size.

At S106, the input signal processor 41 may convert the image data DATA into the first image data DATA1 synchronized with the first internal data enable signal IDE1, or may convert the image data DATA into the second image data DATA2 synchronized with the second internal data enable signal IDE2, depending on whether the frame frequency is determined to be the first or the second frame frequency (e.g., at S103).

In detail, when the frame frequency is determined as the first frame frequency, the input signal processor 41 may output the first image data DATA1 obtained through conversion based on the pulse width of the first internal data enable signal IDE1, as shown in FIG. 7. For example, the first image data DATA1 may be output in synchronization with a pulse of the first internal data enable signal IDE1 and may not be output during a horizontal blank period hb1.

Moreover, when the frame frequency is determined as the second frame frequency, the input signal processor 41 may output the second image data DATA2 obtained through conversion based on the pulse width of the second internal data enable signal IDE2, as shown in FIG. 8. For example, the second image data DATA2 may be output in synchronization with a pulse of the second internal data enable signal IDE2 and may not be output during the horizontal blank period hb2.

At S107, the input signal processor 41 may generate a first horizontal synchronization signal Hsync1 and a first vertical synchronization signal Vsync1 synchronized with the first internal data enable signal IDE1, if the frame frequency was determined to be the first frame frequency (e.g., at S103). To this end, a pulse width of the first horizontal synchronization signal Hsync1 may be adjusted to be synchronized with the first internal data enable signal IDE1. Therefore, even when the first horizontal synchronization signal Hsync1 and the horizontal synchronization signal input from the system board are activated to the same frame frequency, as in FIG. 7, the pulse width of the first horizontal synchronization signal Hsync1 may be narrower than a pulse width of the horizontal synchronization signal input from the system board.

Alternatively, at S107, the input signal processor 41 may generate a second horizontal synchronization signal Hsync2 and a second vertical synchronization signal Vsync2 synchronized with the second internal data enable signal IDE2, if the frame frequency was determined to be the second frame frequency (e.g., at S103). To this end, a pulse width of the second horizontal synchronization signal Hsync2 may be adjusted to be synchronized with the second internal data enable signal IDE2.

At S108, when the frame frequency is determined as the first frame frequency (e.g., at S103), the input signal processor 41 may output the first internal data enable signal IDE1, the first horizontal synchronization signal Hsync1, the first vertical synchronization signal Vsync1, and the first image data DATA1 to the data control signal output unit 42. Thus, the data control signal output unit 42 may generate and output the first data control signal DCS1 having the first frame frequency for controlling the data driver 20 based on the first internal data enable signal IDE1, the first horizontal synchronization signal Hsync1, the first vertical synchronization signal Vsync1, and the first image data DATA1.

Moreover, when the frame frequency is determined as the first frame frequency, the input signal processor 41 may output the first internal data enable signal IDE1, the first horizontal synchronization signal Hsync1, and the first vertical synchronization signal Vsync1 to the gate control signal output unit 43. Thus, the gate control signal output unit 43 may generate and output the first gate control signal GCS1 having the first frame frequency for controlling the gate driver 30 based on the first internal data enable signal IDE1, the first horizontal synchronization signal Hsync1, and the first vertical synchronization signal Vsync1.

When the frame frequency is determined as the second frame frequency, the input signal processor 41 may output the second internal data enable signal IDE2, the second horizontal synchronization signal Hsync2, the second vertical synchronization signal Vsync2, and the second image data DATA2 to the data control signal output unit 42. Thus, the data control signal output unit 42 may generate and output the second data control signal DCS2 having the second frame frequency for controlling the data driver 20 based on the second internal data enable signal IDE2, the second horizontal synchronization signal Hsync2, the second vertical synchronization signal Vsync2, and the second image data DATA2.

Moreover, when the frame frequency is determined as the second frame frequency, the input signal processor 41 may output the second internal data enable signal IDE2, the second horizontal synchronization signal Hsync2, and the second vertical synchronization signal Vsync2 to the gate control signal output unit 43. Thus, the gate control signal output unit 43 may generate and output the second gate control signal GCS2 having the second frame frequency for controlling the gate driver 30 based on the second internal data enable signal IDE2, the second horizontal synchronization signal Hsync2, and the second vertical synchronization signal Vsync2.

As described above, in one or more embodiments of the present disclosure, the pulse width of the data enable signal may be constant in a plurality of frame frequencies. That is, in one or more embodiments of the present disclosure, the pulse width of the first internal data enable IDE1 signal may be the same as that of the second internal data enable signal IDE2 in the first frame frequency. As a result, in one or more embodiments of the present disclosure, it is not required for the data control signal output unit 42 and the gate control signal output unit 43 disposed next to the input signal processor 41 to adjust counting of the internal clock ICLK according to a frame frequency. That is, the data control signal output unit 42 and the gate control signal output unit 43 may process the input signal by using only the internal clock ICLK. Accordingly, in one or more embodiments of the present disclosure, despite the display device being driven at the plurality of frame frequencies, an internal logic is simplified.

Moreover, in embodiments of the present disclosure, since the internal logic is simplified, it is not required to distinguish blocks processing the image data DATA and the timing signals TS according to the frame frequency. Accordingly, in embodiments of the present disclosure, despite the display device being driven at the plurality of frame frequencies, the cost does not increase without any increase in size.

FIG. 7 is a waveform diagram showing the first internal data enable signal IDE1, the first vertical synchronization signal Vsync1, the first horizontal synchronization signal Hsync1, and the first image data DATA1 generated by the timing controller 40. FIG. 8 is a waveform diagram showing the second internal data enable signal IDE2, the second vertical synchronization signal Vsync2, the second horizontal synchronization signal Hsync2, and the second image data DATA2 generated by the timing controller 40.

In FIG. 7, the first internal data enable signal IDE1, the first vertical synchronization signal Vsync1, the first horizontal synchronization signal Hsync1, and the first image data DATA1 are shown as having a frame frequency of 60 Hz as an example of the first frame frequency. In FIG. 8, the second internal data enable signal IDE2, the second vertical synchronization signal Vsync2, the second horizontal synchronization signal Hsync2, and the second image data DATA2 are shown as having a frame frequency of 120 Hz as an example of the second frame frequency.

In the frame frequency of 60 Hz, one frame period is about 16.67 ms, as shown in FIG. 7. In the frame frequency of 120 Hz, one frame period is about 8.33 ms, as shown in FIG. 8.

The one frame period may include an active period ACT, where valid image data is supplied, and a vertical blank period VBI which is an idle period. The first and second internal data enable signals IDE1 and IDE2 and the image data may not be output during the vertical blank period VBI.

Referring to FIGS. 7 and 8, the frame frequency of the first internal data enable signal IDE1 differs from that of the second internal data enable signal IDE2, and thus the pulse width W3 of the first internal data enable signal IDE1 is substantially the same as the pulse width W4 of the second internal data enable signal IDE2. Also, since the frame frequency of the first internal data enable signal IDE1 is lower than that of the second internal data enable signal IDE2, a horizontal blank period hb1 of the first internal data enable signal IDE1 is longer than a horizontal blank period hb2 of the second internal data enable signal IDE2.

As shown in FIG. 7, the first horizontal synchronization signal Hsync1 indicates one horizontal period, and thus, has a period corresponding to the one horizontal period. The first internal data enable signal IDE1 also has a period corresponding to the one horizontal period, and thus the period of the first horizontal synchronization signal Hsync1 is substantially the same as that of the first internal data enable signal IDE1.

As shown in FIG. 8, the second horizontal synchronization signal Hsync2 indicates one horizontal period, and thus has a period corresponding to the one horizontal period. The second internal data enable signal IDE2 also has a period corresponding to the one horizontal period, and thus the period of the second horizontal synchronization signal Hsync2 is substantially the same as that of the second internal data enable signal IDE2.

The first image data DATA1 may be output in synchronization with a pulse of the first internal data enable signal IDE1. Accordingly, the first image data DATA1 may not be output during the horizontal blank period hb1 of the first internal data enable signal IDE1.

The second image data DATA2 may be output in synchronization with a pulse of the second internal data enable signal IDE2. Accordingly, the second image data DATA2 may not be output during the horizontal blank period hb2 of the second internal data enable signal IDE2.

As described above, in one or more embodiments of the present disclosure, the pulse width of the data enable signal may be constant in a plurality of frame frequencies. That is, in one or more embodiments of the present disclosure, the pulse width of the first internal data enable signal IDE1 may be the same as that of the second internal data enable signal IDE2 in the first frame frequency. As a result, in embodiments of the present disclosure, it is not required for the data control signal output unit 42 and the gate control signal output unit 43 disposed next to the input signal processor 41 to adjust counting of the internal clock ICLK according to a frame frequency. That is, the data control signal output unit 42 and the gate control signal output unit 43 may process the input signal by using only the internal clock ICLK. Accordingly, in one or more embodiments of the present disclosure, despite the display device being driven at the plurality of frame frequencies, an internal logic is simplified.

Moreover, in embodiments of the present disclosure, since the internal logic is simplified, it is not required to distinguish blocks processing the image data DATA and the timing signals TS according to the frame frequency. Accordingly, in embodiments of the present disclosure, despite the display device being driven at the plurality of frame frequencies, the cost does not increase without any increase in size.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A timing controller, comprising:

an input signal processor configured to:

receive a data enable signal and a frame frequency information signal, select one of a first frame frequency and a second frame frequency, based on the received frame frequency information signal, generate a first internal data enable signal having a first frame frequency in response to the first frame frequency being selected based on the frame frequency information signal, and generate a second internal data enable signal having a second frame frequency in response to the second frame frequency being selected based on the frame frequency information signal, the second frame frequency being different than the first frame frequency;

a gate control signal output unit communicatively coupled to the input signal processor, the gate control signal output unit configured to:

generate and output one of a first gate control signal based on the first internal data enable signal, and a second gate control signal based on the second internal data enable signal; and a data control signal output unit communicatively coupled to the input signal processor and the gate control signal output unit, the data control signal output unit configured to:

generate and output one of a first data control signal based on the first internal data enable signal, and a second data control signal based on the second internal data enable signal, wherein a pulse width of the first internal data enable signal is the same as a pulse width of the second internal data enable signal.

2. The timing controller of claim 1, wherein a horizontal blank period of the first internal data enable signal is longer than a horizontal blank period of the second internal data enable signal when the first frame frequency is lower than the second frame frequency.

3. The timing controller of claim 2, wherein the input signal processor receives image data and converts the image data into one of first image data that is synchronized with the first internal data enable signal, and second image data that is synchronized with the second internal data enable signal.

4. The timing controller of claim 3, wherein the input signal processor is further configured to:

output the first image data in synchronization with a pulse of the first internal data enable signal, and the first image data is not output during the horizontal blank period of the first internal data enable signal, and output the second image data in synchronization with a pulse of the second internal data enable signal, and the second image data is not output during the horizontal blank period of the second internal data enable signal.

5. The timing controller of claim 3, wherein the data control signal output unit outputs one of the first data control signal with the first image data, and the second data control signal with the second image data.

6. The timing controller of claim 3, wherein the input signal processor is further configured to:

generate a first vertical synchronization signal and a first horizontal synchronization signal having the first frame frequency based on the first internal data enable signal in response to the first frame frequency being selected, and generate a second vertical synchronization signal and a second horizontal synchronization signal having the second frame frequency based on the second internal data enable signal in response to the second frame frequency being selected.

7. The timing controller of claim 1, wherein a pulse width of the data enable signal differs from the pulse width of the first internal data enable signal.

8. A display device, comprising:

a display panel including a plurality of gate lines, a plurality of data lines, and a plurality of pixels, each of the pixels being connected to a respective gate line of the plurality of gate lines and to a respective data line of the plurality of data lines;

a gate driver configured to output gate signals to the plurality of gate lines;

a data driver configured to output data voltages to the plurality of data lines; and a timing controller configured to control an operation timing of the gate driver and an operation timing of the data driver, wherein the timing controller comprises:

an input signal processor configured to:

receive a data enable signal and a frame frequency information signal, select one of a first frame frequency and a second frame frequency, based on the frame frequency information signal, generate a first internal data enable signal having a first frame frequency in response to the first frame frequency being selected based on the frame frequency information signal, and generate a second internal data enable signal having a second frame frequency in response to the second frame frequency being selected based on the frame frequency information signal, the second frame frequency being different than the first frame frequency;

a gate control signal output unit coupled to the input signal processor, the gate control signal output unit configured to generate and output one of a first gate control signal based on the first internal data enable signal, and a second gate control signal based on the second internal data enable signal; and a data control signal output unit coupled to the input signal processor and the gate control signal output unit, the data control signal output unit configured to generate and output one of a first data control signal based on the first internal data enable signal, and a second data control signal based on the second internal data enable signal, wherein a pulse width of the first internal data enable signal is the same as a pulse width of the second internal data enable signal.

9. The display device of claim 8, wherein a horizontal blank period of the first internal data enable signal is longer than a horizontal blank period of the second internal data enable signal when the first frame frequency is lower than the second frame frequency.

10. The timing controller of claim 9, wherein the input signal processor receives image data and converts the image data into one of first image data that is synchronized with the first internal data enable signal, and second image data that is synchronized with the second internal data enable signal.

11. The display device of claim 10, wherein:

the first image data is output in synchronization with a pulse of the first internal data enable signal and is not output during the horizontal blank period of the first internal data enable signal; and the second image data is output in synchronization with a pulse of the second internal data enable signal and is not output during the horizontal blank period of the second internal data enable signal.

12. The display device of claim 10, wherein the data control signal output unit outputs the first data control signal with the first image data, and outputs the second data control signal with the second image data.

13. The display device of claim 8, wherein a pulse width of the data enable signal differs from the pulse width of the first internal data enable signal.

14. A method of driving a display device, the method comprising:

receiving image data and a frame frequency information signal from an external system board;

accessing a memory storing first frame frequency data and second frame frequency data;

selecting one of a first frame frequency corresponding with the first frame frequency data, and a second frame frequency corresponding with the second frame frequency data, based on the received frame frequency information signal;

generating one of a first internal data enable signal having the first frame frequency in response to the first frame frequency being selected, and a second internal data enable signal having the second frame frequency in response to the second frame frequency being selected;

generating and outputting to a gate driver one of a first gate control signal based on the first internal data enable signal, and a second gate control signal based on the second internal data enable signal; and generating and outputting to a data driver one of a first data control signal based on the first internal data enable signal, and a second data control signal based on the second internal data enable signal, wherein a pulse width of the first internal data enable signal is the same as a pulse width of the second internal data enable signal.

15. The method of claim 14, wherein a horizontal blank period of the first internal data enable signal is longer than a horizontal blank period of the second internal data enable signal when the first frame frequency is lower than the second frame frequency.

16. The method of claim 15, further comprising: receiving image data and converting the image data into one of first image data that is synchronized with the first internal data enable signal, and second image data that is synchronized with the second internal data enable signal.

17. The method of claim 16, wherein:

the first image data is output in synchronization with a pulse of the first internal data enable signal and is not output during the horizontal blank period of the first internal data enable signal; and the second image data is output in synchronization with a pulse of the second internal data enable signal and is not output during the horizontal blank period of the second internal data enable signal.

18. The method of claim 16, wherein generating and outputting to the data driver one of the first data control signal and the second data control signal comprises outputting one of the first data control signal with the first image data, and the second data control signal with the second image data.

19. The method of claim 16, further comprising:

generating a first vertical synchronization signal and a first horizontal synchronization signal having the first frame frequency based on the first internal data enable signal in response to the first frame frequency being selected; and generating a second vertical synchronization signal and a second horizontal synchronization signal having the second frame frequency based on the second internal data enable signal in response to the second frame frequency being selected.

20. The method of claim 14, wherein a pulse width of the data enable signal differs from the pulse width of the first internal data enable signal.

* * * * *